US010600607B1

(12) United States Patent
Kelly et al.

(10) Patent No.: US 10,600,607 B1
(45) Date of Patent: Mar. 24, 2020

(54) SYSTEM WITH A HIGH-POWER MICROWAVE VACUUM TUBE (HPM-VT) DEVICE HAVING NON-EVAPORABLE GETTERS (NEG) INTEGRATED IN AN RF CAVITY

(71) Applicant: LOCKHEED MARTIN CORPORATION, Bethesda, MD (US)

(72) Inventors: Patrick M. Kelly, Colleyville, TX (US); James-William B. Bragg, Highland Village, TX (US)

(73) Assignee: LOCKHEED MARTIN CORPORATION, Bethesda, MD (US)

( * ) Notice: Subject to any disclaimer, the term of this patent is extended or adjusted under 35 U.S.C. 154(b) by 0 days.

(21) Appl. No.: 16/396,150

(22) Filed: Apr. 26, 2019

Related U.S. Application Data

(60) Provisional application No. 62/664,567, filed on Apr. 30, 2018.

(51) Int. Cl.

| | |
|---|---|
| ***H05B 31/26*** | (2006.01) |
| ***H01J 7/24*** | (2006.01) |
| ***H01J 23/20*** | (2006.01) |
| ***H01J 23/16*** | (2006.01) |

(52) U.S. Cl.
CPC ..... *H01J 23/20* (2013.01); *H01J 23/165* (2013.01)

(58) Field of Classification Search
CPC .... H05H 1/46; H05H 1/24; H05H 1/30; H01J 37/32082; H01J 37/32192; H01J 37/32174; H01J 3/021; H01J 27/16; H01J 37/08; H01J 37/3171; H01J 27/18; H01J 27/08; H01J 27/14; H01J 41/04; H01J 41/14; H01J 41/06; H01T 23/00; H01T 19/00
See application file for complete search history.

(56) References Cited

U.S. PATENT DOCUMENTS

| | | | | |
|---|---|---|---|---|
| 8,691,158 | B2 * | 4/2014 | Hanai | A61L 9/22 422/305 |
| 2012/0244529 | A1 * | 9/2012 | Fuchs | B01L 3/5027 435/6.11 |
| 2018/0363141 | A1 * | 12/2018 | Duclos | C23C 16/045 |

OTHER PUBLICATIONS

Kelly et al., "Performance of St707 Getter Material in a Rep-Rated High Power Microwave Sealed-Tube Vircator Under UHV Conditions," IEEE, 2014.
Manini et al., "Deposition of Non Evaporable Getter (NEG) Films on Vacuum Chambers for High Energy Machines and Synchrotron Radiation Sources," Proceedings of EPAC 2006, Edinburgh, Scotland.

* cited by examiner

*Primary Examiner* — Minh D A
(74) *Attorney, Agent, or Firm* — Terry M. Sanks, Esq.; Beusse Wolter Sanks & Maire, PLLC

(57) ABSTRACT

A device comprising an RF cavity enclosure including a tubular section having a plurality of interior structures radially or axially arranged which forms an unobstructed inner hollow center within the tubular section. Each interior structure of the plurality of interior structures includes side walls between which is formed an internal hollow sub-cavity. Resonating cavities exist between adjacent interior structures to produce a resonating frequency response. Vents are formed in at least one side wall for permeation of a gas into the internal hollow sub-cavity. A high-power microwave system and method of manufacture are provided.

20 Claims, 10 Drawing Sheets

100
140
142
146
128B
130B
154
152
150
110
128A
130A
132
160

100
152
154
155
150
160
110
125
125
160
120
114
112
116A
118
116B
128A
116C
120
117
111
114
175
170
128B
130B
140
142
146
105
130A
132

350
317
311
316C
320
320
316A
360

318
316B
328
360
314
210
211
214
217
220
220

219
218
203
260
216B
216A
216C
464
462
460
301
320
322
360
NEG
316

SYSTEM WITH A HIGH-POWER MICROWAVE VACUUM TUBE (HPM-VT) DEVICE HAVING NON-EVAPORABLE GETTERS (NEG) INTEGRATED IN AN RF CAVITY

CROSS-REFERENCE TO RELATED APPLICATIONS

This application claims the benefit of U.S. Provisional Application No. 62/664,567, titled "SYSTEM WITH A HIGH POWER MICROWAVE VACUUM TUBE (HPM-VT) DEVICE HAVING NON-EVAPORABLE GETTERS (NEG) INTEGRATED IN AN RF CAVITY," filed Apr. 30, 2018, and being incorporated herein by reference in its entirety.

BACKGROUND

Embodiments relate to systems having a high-power microwave vacuum tube (HPM-VT) and devices with non-evaporable getters (NEG) integrated in an RF cavity enclosure. The embodiments also include a method of manufacturing the HPM-VT device.

A high-power microwave vacuum tube device may include a solid metal layer that acts as an electrode of a first polarity. An electrode of opposite polarity is journaled along an axis of the tube within the hollow center dimensioned to receive the electrode. Traditional high-power microwave vacuum tube devices require the use of large vacuum support equipment during operational use or require a high degree of maintenance for long shelf life.

The vacuum support equipment may include one or more of a positive displacement pump, momentum transfer pump, regenerative pump and an entrapment pump. The vacuum pump(s) is generally a separate chamber from the vacuum tube chamber with a vacuum gauge coupled to the pump and/or chamber. The vacuum support equipment evacuates gas to maintain the vacuum space. The vacuum gauge measures the quantity of gas in the chamber.

SUMMARY

Embodiments relate to systems having high-power microwave vacuum tube (HPM-VT) devices with non-evaporable getters (NEG) integrated in an RF cavity enclosure. The embodiments also include a method of manufacturing the HPM-VT device.

An aspect of the embodiments includes a device comprising an RF cavity enclosure including a conductive tubular section having a plurality of interior structures oriented radially or axially which forms an unobstructed inner hollow center within the tubular section. The interior of the RF cavity enclosure being an RF cavity. Each interior structure of the plurality of interior structures includes side walls between which is formed an internal hollow sub-cavity. Resonating cavities exist between adjacent interior structures to produce a resonating frequency response. Vents are formed in at least one side wall of said each interior structure for permeation of a gas into the internal hollow cavity. The vents are designed such that they do not interfere with the resonating frequency response of the interior structure or collective resonance of a plurality of interior structures.

An aspect of the embodiments includes a method comprising forming a layer of an RF cavity enclosure including a conductive tubular section having a plurality of interior structures radially or axially arranged which forms an unobstructed inner hollow center within the tubular section. Each interior structure of the plurality of interior structures includes side walls between which forms an internal hollow sub-cavity. The method includes during the forming of the layer of the RF cavity enclosure, forming, in at least one side wall of said each interior structure, at least one vent for permeation of a gas into the internal hollow sub-cavity. The method comprises repeating the forming of the layer of the RF cavity enclosure using additive manufacturing to produce a length of the RF cavity enclosure having a plurality of layers and the forming of the at least one vent in the at least one side wall.

Another aspect of the embodiments includes a system comprising an RF cavity enclosure being configured as an electrode and including a tubular section having a plurality of interior structures radially or axially arranged which forms an unobstructed inner hollow center within the tubular section. Each interior structure of the plurality of interior structures includes side walls between which is formed an internal hollow sub-cavity. The system includes resonating cavities between adjacent interior structures configured to produce a resonating frequency response. The system includes non-evaporable getter (NEG) modules installed in the internal hollow sub-cavity of said each interior structure. Vents are formed in at least one side wall of said each interior structure for permeation of a gas into the internal hollow sub-cavity. The system includes an opposite polarity electrode journaled along the inner hollow center.

BRIEF DESCRIPTION OF THE DRAWINGS

A more particular description briefly stated above will be rendered by reference to specific embodiments thereof that are illustrated in the appended drawings. Understanding that these drawings depict only typical embodiments and are not therefore to be considered to be limiting of its scope, the embodiments will be described and explained with additional specificity and detail through the use of the accompanying drawings in which.

DETAILED DESCRIPTION

Figures 1A, 1B:
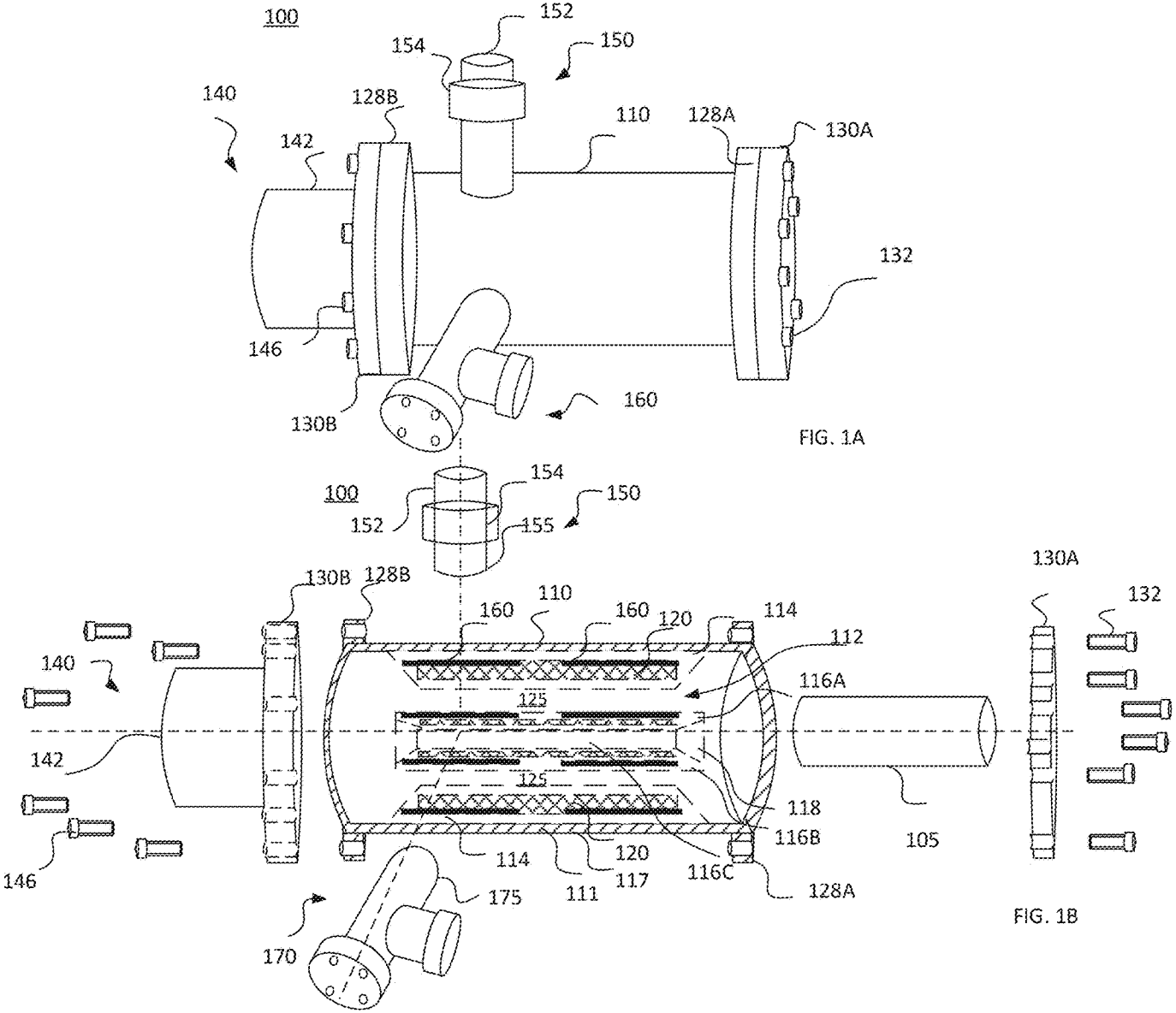
FIG. 1A illustrates a side perspective view of a high-power microwave vacuum tube device.
FIG. 1B illustrates an exploded view of the high-power microwave vacuum tube device of FIG. 1A with a portion of the vacuum tube partially removed.

Embodiments are described herein with reference to the attached figures wherein like reference numerals are used throughout the figures to designate similar or equivalent elements. The figures are not drawn to scale and they are provided merely to illustrate aspects disclosed herein. Several disclosed aspects are described below with reference to non-limiting example applications for illustration. It should be understood that numerous specific details, relationships, and methods are set forth to provide a full understanding of the embodiments disclosed herein. One having ordinary skill in the relevant art, however, will readily recognize that the disclosed embodiments can be practiced without one or more of the specific details or with other methods. In other instances, well-known structures or operations are not shown in detail to avoid obscuring aspects disclosed herein. The embodiments are not limited by the illustrated ordering of acts or events, as some acts may occur in different orders and/or concurrently with other acts or events. Furthermore, not all illustrated acts or events are required to implement a methodology in accordance with the embodiments.

Notwithstanding that the numerical ranges and parameters setting forth the broad scope are approximations, the numerical values set forth in specific non-limiting examples are reported as precisely as possible. Any numerical value, however, inherently contains certain errors necessarily resulting from the standard deviation found in their respective testing measurements. Moreover, all ranges disclosed herein are to be understood to encompass any and all sub-ranges subsumed therein. For example, a range of "less than 10" can include any and all sub-ranges between (and including) the minimum value of zero and the maximum value of 10, that is, any and all sub-ranges having a minimum value of equal to or greater than zero and a maximum value of equal to or less than 10, e.g., 1 to 4.

The embodiments of the high-power microwave vacuum tube (HPM-VT) device eliminate the need for one or more or any combination of a positive displacement pump, momentum transfer pump, regenerative pump and an entrapment pump. The elimination of one or more or any combination of the positive displacement pump, momentum transfer pump, regenerative pump and an entrapment pump also eliminates the maintenance associated with these traditional components associated with the HPM-VT device and mechanical or electrical failure of these traditional components.

The embodiments of the high-power microwave vacuum tube (HPM-VT) device integrate non-evaporable getter (NEG) modules in hollowed radial or axially arranged structures within the RF cavity to absorb gases directly in the vacuum chamber.

The HPM-VT device may be configured as a magnetron, MILO (magnetically insolated line oscillator), BWO (backward wave oscillator), VIRCATOR (virtual cathode oscillator), or TWT (travelling wave tube) or any other high-power microwave device of a different topology, but operating in similar fashion.

High-power microwave may include a high-power radio frequency (RF).

With reference to FIGS. 1A and 1B, a side perspective view and exploded view of a high-power microwave vacuum tube (HPM-VT) device 100 is shown. In FIG. 1B, a portion of the vacuum tube or RF cavity enclosure is partially removed. The HPM-VT device 100 may include other elements or structures which are known, but have been omitted for the sake of brevity. The HPM-VT device 100 may comprise a main vacuum tube (VT) chamber 110 with open ends. A first end of the vacuum tube chamber 110 is closed by a first baffle wall 130A. The first end of the vacuum tube chamber 110 may comprise a flange 128A for coupling the baffle wall 130A to the first end such that the first end of the vacuum tube chamber 110 may be sealed. The baffle wall 130A and flange 128A may include aligned holes for receipt of fasteners 132 such as, without limitation, bolts.

The baffle wall 130A may be conductive or dielectric (non-conductive) depending on HPM-VT cavity topology through which RF energy may radiate.

A second end of the vacuum tube chamber 110 may comprise flange 128B for attachment of a first sub-assembly 140 housed in housing 142. The housing 142 may include a baffle wall 130B for attachment to flange 128B. The vacuum tube chamber 110 may be hermetically sealed. The first sub-assembly 140 may access the vacuum tube chamber 110 in-line with the longitudinal axis of the vacuum tube chamber 110 through an opening in the baffle wall 130B and flange 128B. The baffle wall 130A and flange 128A include aligned holes for receipt of fasteners 132, such as bolts. The baffle wall 130B and flange 128B may include aligned holes for receipt of fasteners 146, such as bolts.

The HPM-VT device 100 may comprise a second sub-assembly 170 having access generally perpendicular to the longitudinal axis of the vacuum tube chamber 110. The HPM-VT device 100 may comprise a third sub-assembly 150 having access generally perpendicular to the longitudinal axis of the vacuum tube chamber 110. The access port 175 of the second sub-assembly 170 to the vacuum tube chamber 110 is generally 90° offset from the access port 155 of the third sub-assembly into the vacuum tube chamber 110. A center of the access port 155 and the center of the access port 175 may perpendicularly intersect the longitudinal axis of the vacuum tube chamber 110. Nevertheless, the center of the access ports 155 and 175 may enter at an angle relative to the longitudinal axis of the vacuum tube chamber 110.

The sub-assemblies 150 and 170 may provide access to the vacuum tube (VT) chamber 110 for diagnostic equipment, for mechanical adjustment of structures within the RF cavity, for ease-of-assembly of internal components, or for electrical connections to internal components.

Figure 7A:
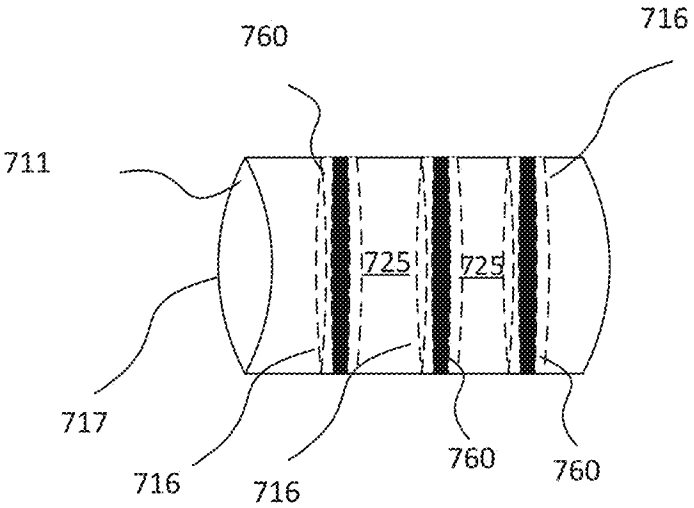
FIG. 7A illustrates a perspective view of another RF cavity enclosure with axially arranged integrated NEG modules.
Figure 7B:
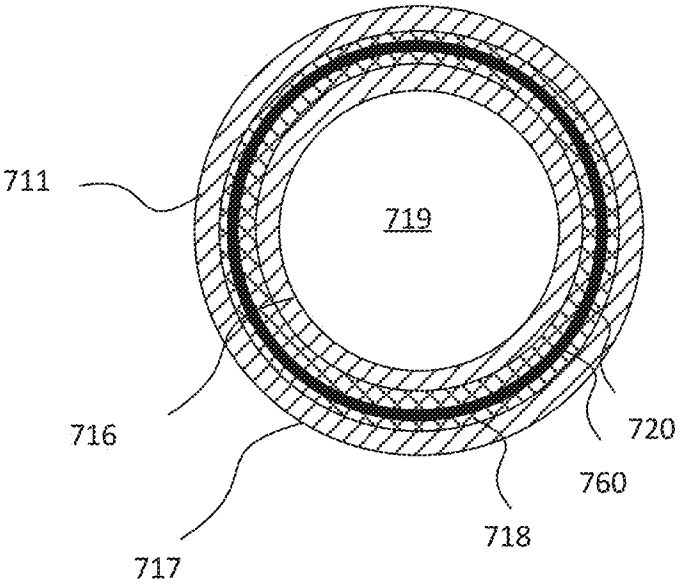
FIG. 7B illustrates a cross-sectional view of the RF cavity enclosure of FIG. 7A.

As can be seen in FIG. 1B, the VT chamber 110 includes an RF cavity enclosure 111 having interior structures 114 which radiate toward a center of the VT chamber 110, but leave a hollow center within the VT chamber 110 or RF cavity enclosure 111, in some embodiments. The separation between adjacent periodic interior structures 114 may form resonating cavities 125. The geometric shape and periodicity of the interior structures 114 may be varied to change the geometry of the resonating cavities and thus the particular resonating frequency response. The periodic interior structures 114 may be axially arranged, as shown in FIGS. 7A and 7B and/or radially arranged, as shown in FIG. 1B. The axially arranged embodiment of FIGS. 7A and 7B will be described later.

The center of the VT chamber 110 may correspond to the center of the RF cavity enclosure 111. Both the VT chamber 110 and RF cavity enclosure 111 have a tubular section 117 with a tubular configuration. The RF cavity enclosure 111 may form a main internal hollow cavity bounded by the wall of the enclosure 111.

Each interior structure 114 within the RF cavity enclosure 111 may include a first side wall 116A, a second side wall 116B and a third side wall 116C. The third side wall 116C may intersect the first side wall 116A and the second side wall 116B. The third side wall 116C may have an arc shape, in some embodiments, which generally tracks the curvature of the tubular configuration of the tubular section 117 of the RF cavity enclosure 111.

The first, second and third side walls 116A, 116B and 116C form a secondary enclosure with an internal hollow sub-cavity 118. One or more of the side walls 116A, 116B and 116C may include one or more vents 120. In the illustration, the first and second side walls 116A and 116B include vents 120. Each side wall 116A or 116B may include a plurality of vents along the longitudinal length or axial orientation thereof or one elongated vent along the longitudinal length or axial orientation. The side walls 116A and 116B are integrated with the tubular section 117 at first ends. In some embodiments, that portion of the tubular section 117 between the first ends of side walls 116A and 116B of the same interior structure 114 may form a bottom surface or floor of such interior structure 114. The third side wall 116C may be integrated with second free ends of the side walls 116A and 116B.

Integrated into at least one of the first and second side walls 116A and 116 are non-evaporable getters (NEG) modules 160 including NEG material. The vent 120 allows gas to permeate into the internal hollow sub-cavity 118 where the gas is sorbed (absorbed) by the NEG material to maintain the vacuum condition of the tube chamber 110. The NEG material may comprise TiZrV (Titanium, Zirconium, Vanadium) or any other number of passive alloys combined in various compositions (percentages). The NEG material may be configured to have a low to high activation temperature. The NEG material may be a combination of, or a single passive metallic alloy not limited to or not necessarily including TiZrV.

In some embodiments, related to axially-arranged interior structures, non-evaporable getters (NEG) modules may have an arc shape or flat shape whose tangent follows the longitudinal center of the RF cavity.

The vacuum tube or RF cavity enclosure 111 may include at least one metal layer that acts as an electrode. The RF cavity enclosure may sometimes be referred to as an electrode enclosure. An opposite polarity electrode 105 is journaled along the longitudinal axis of the RF cavity enclosure 111 within the hollow center dimensioned to receive the opposite polarity electrode 105. In some embodiments, the VT chamber 110 may include one or more outer layers (not shown) which surround the tubular section 117 of the RF cavity enclosure 111.

Figures 2, 3A, 3B, 4:
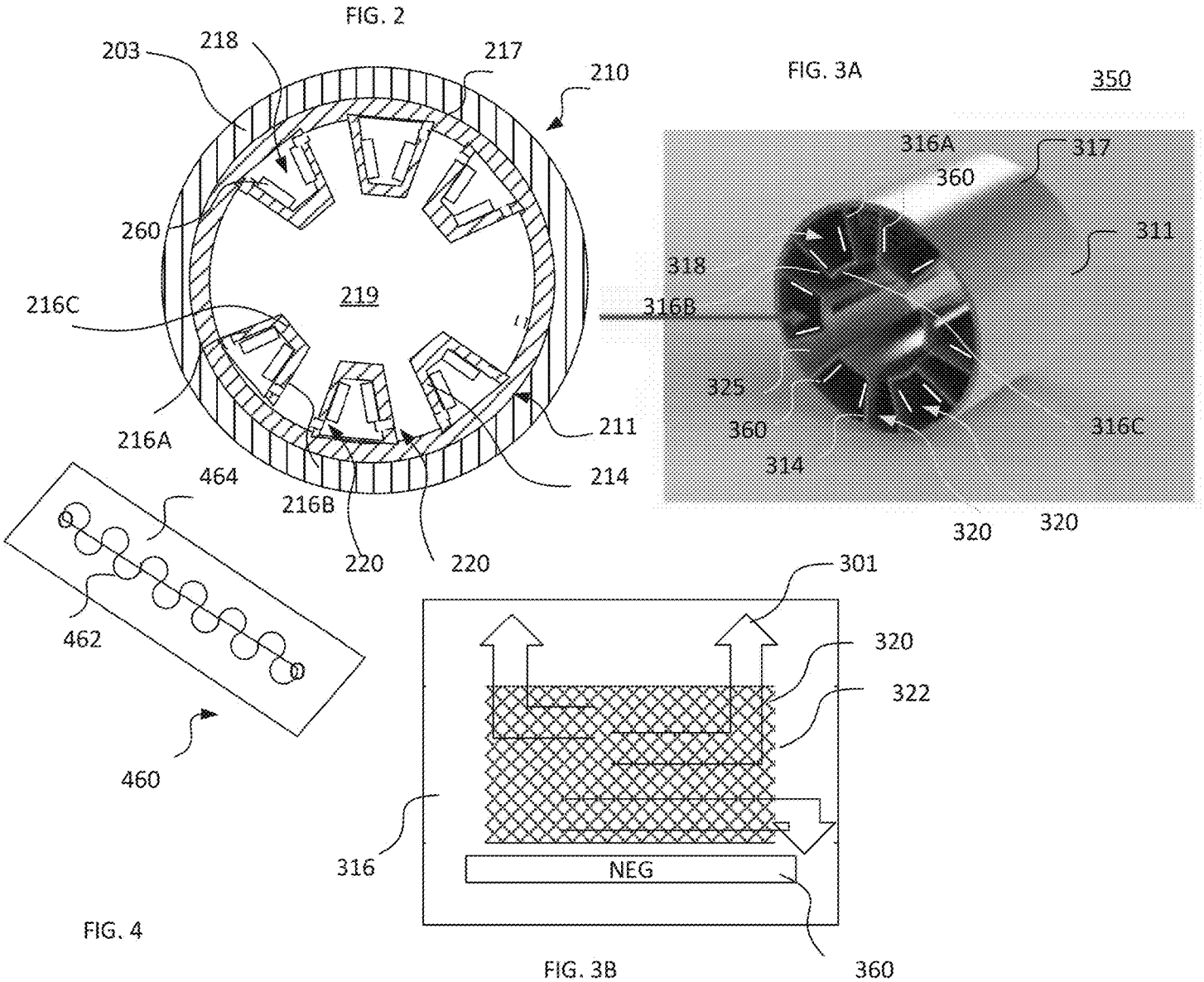
FIG. 2 illustrates a cross-sectional end view of the vacuum tube (VT) RF cavity enclosure with integrated non-evaporable getter (NEG) modules in the RF cavity.
FIG. 3A illustrates a perspective view vacuum tube RF cavity section.
FIG. 3B illustrates a portion of a wall of a corresponding one interior structure.
FIG. 4 illustrates a notional NEG module.

FIG. 2 illustrates a cross-sectional end view of the RF cavity enclosure 211 with integrated non-evaporable getter (NEG) modules 260. The VT chamber 210 may include at least one outer layer 203 and a layer of an inner RF cavity enclosure 211. The material of the outer layer 203 may be the same as the inner RF cavity enclosure 211 or may be a different material. For example, the outer layer 203 may be stainless steel while the inner RF cavity enclosure 211 may be made of conductive material, such as without limitation, copper. Nonetheless, other metal materials may be used for the RF cavity enclosure 211. Furthermore, the material of the outer layer 203 may be one or more layers and not just one layer. The RF cavity enclosure 211 and the outer layer 203 may be made of conductive material, such as stainless steel, by way of non-limiting example. The inner RF cavity enclosure 211 may be made of Titanium (Ti).

The RF cavity enclosure 211 includes a tubular section 217 from which periodic or near periodic interior structures 214 radiate therefrom and toward a center of the outer tubular member 209. The longitudinal axis of the outer tubular section 217 is generally the same as the outer layer 203 of the VT chamber 210.

Each interior structure 214 may include a first side wall 216A, a second side wall 216B and a third side wall 216C. The first, second and third side walls 216A, 216B and 216C form an enclosure with an internal hollow sub-cavity 218. One or more of the side walls 216A, 216B and 216C may include one or more vents 220. In the illustration, the first and second side walls 216A and 216B include vents 220. Each side wall 216A or 216B may include a plurality of vents 220 along the longitudinal length thereof. The longitudinal center 219 of the RF cavity enclosure 211 is generally hollow for the receipt of opposite polarity electrode 105 (FIG. 1B). The longitudinal center 219 includes that inner space between oppositely opposing the third side walls 216C of oppositely opposing internal structures 214 periodically spaced around an interior surface within enclosure 211. The electrode 105 may have a cylindrical shape.

FIG. 3A illustrates a perspective view of a VT RF cavity section 350. The VT RF cavity enclosure section 350 includes a length of RF cavity 311 having formed therein vents 320. The VT RF cavity enclosure section 350 may include a length of the tubular section 217. The first, second and third side walls 316A, 316B and 316C form an enclosure with an internal hollow sub-cavity 318. NEG modules 360 are affixed in the hollow sub-cavity 318 to the interior side of the first and second side walls 216A and 216B. The exterior side of the first and second side walls 216A and 216B forming the resonating cavities 325 between node interior structure 314.

FIG. 3B illustrates a portion of a wall 316 of a corresponding one interior structure 314. The wall 316 includes vent 320 configured as a mesh or grid or slot. The mesh may include voids 322 through which gas may permeate. The NEG module may be configured to sorb active gases. The arrows 301 denote permeation of gas through the voids 322 of the vent 320.

FIG. 4 illustrates a notional NEG module 460. The NEG module 460 includes NEG material 462 configured to be mounted or attached to the interior surface of a side wall of the internal hollow sub-cavity 118, 218 or 318. In the illustration, the NEG module 460 includes a mounting plate 464 which may be affixed to a side wall. The mounting plate may include two mounting plates coupled to each end of the NEG material 462. The NEG material 462 is shown as a serpentine structure. Other geometric shapes may be used. The serpentine structure may provide a volume of NEG material 462 which can sorb the active gas relative to the size of the VT chamber 110. A solid block of NEG material may be used instead of a serpentine structure. The geometric shape of the NEG material 462 may be a function of each interior structure 114, 214 or 314 (FIG. 1A, 1B, 2 or 3A). The NEG module 460 may be configured to be attached to an interior surface of the tubular section 117, 217 or 317 (FIG. 1A, 1B, 2 or 3A) wherein the tubular section may serve as a floor of the internal hollow sub-cavity 118, 218 or 318 (FIG. 1A, 1B, 2 or 3A).

Figure 5A:
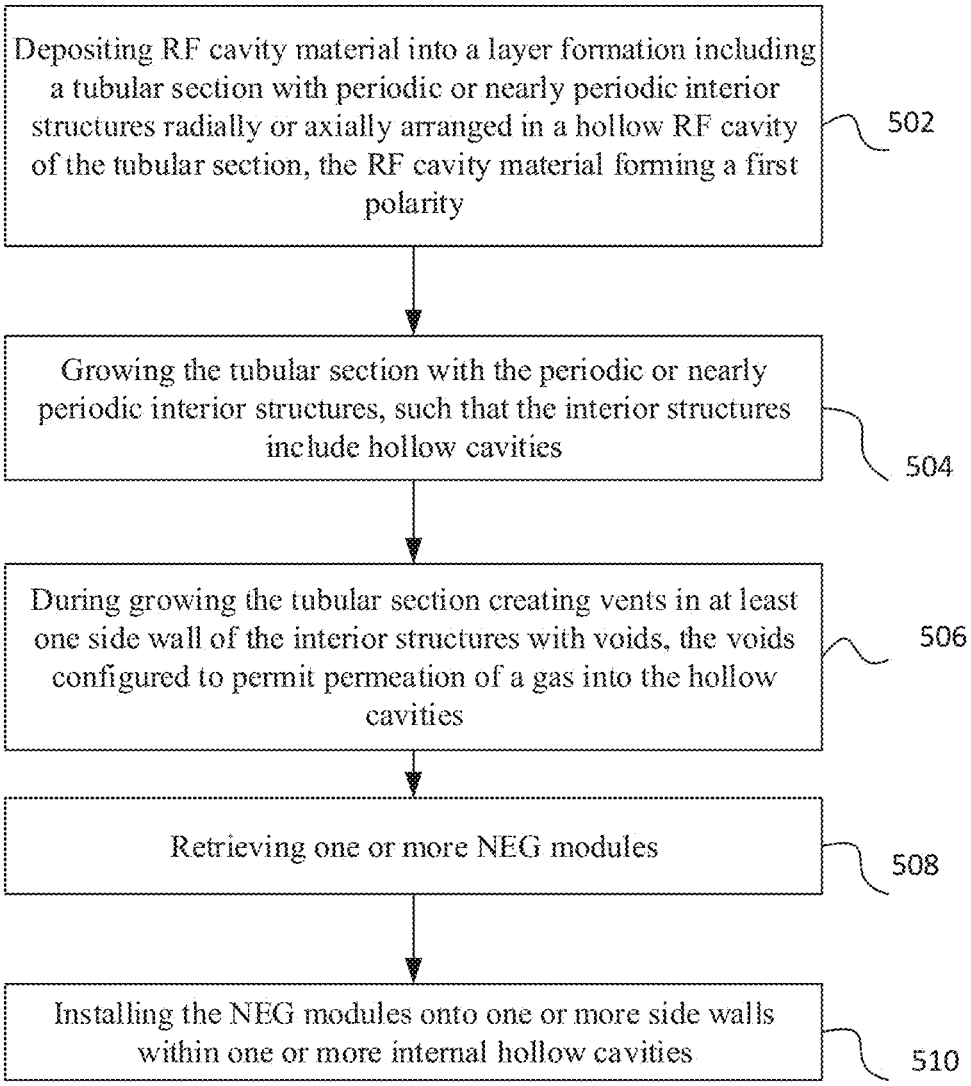
FIGS. 5A and 5B illustrate a flowchart of a method of manufacturing the VT RF cavity enclosure with NEG modules installed in the RF cavity.
Figure 5B:
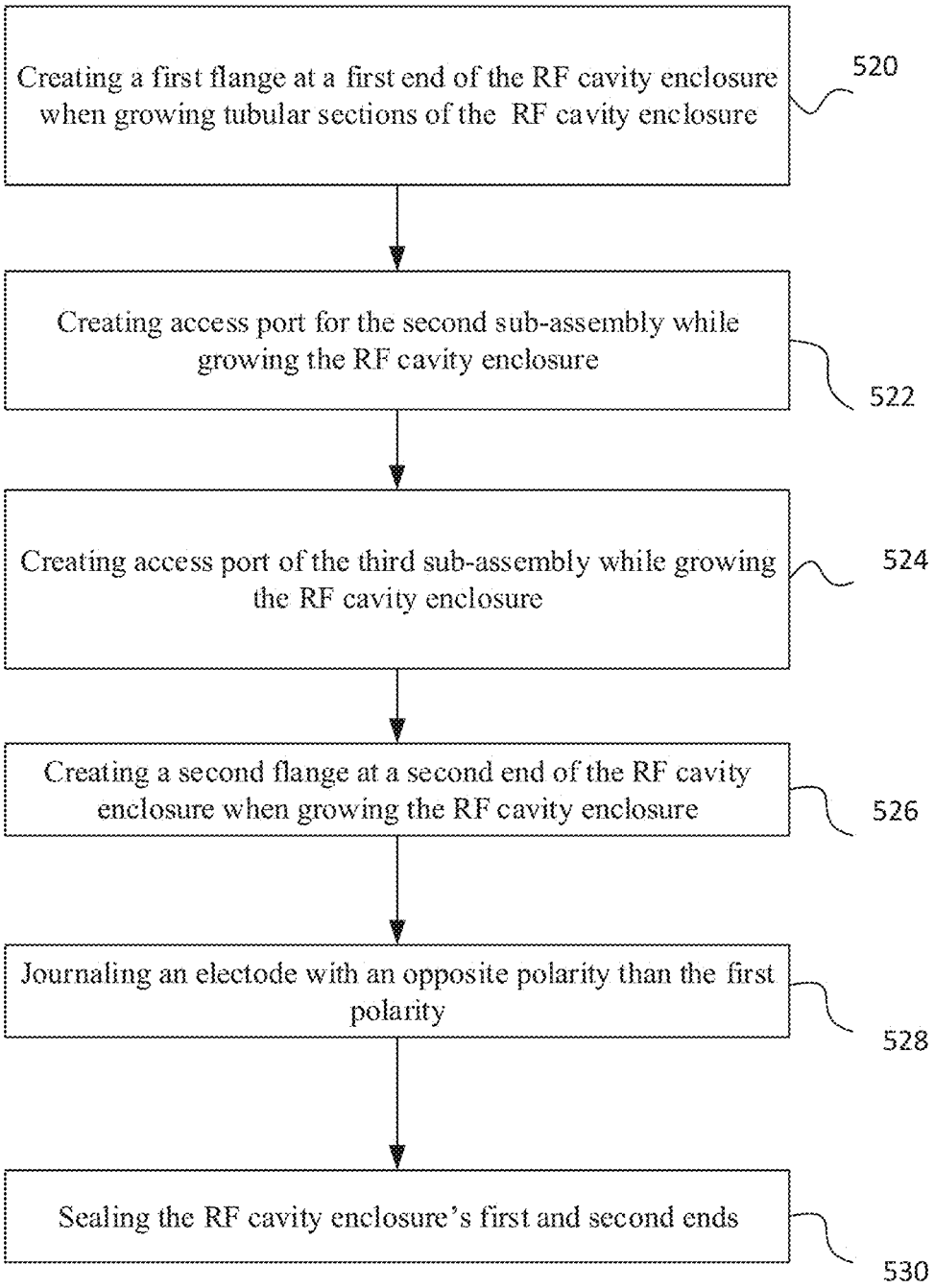

FIGS. 5A and 5B illustrate a flowchart of a method 500 of manufacturing the vacuum tube RF cavity enclosure with NEG modules installed. FIGS. 5A and 5B will be described in relation to FIGS. 6A-6E. The method 500 may be performed in the order shown or a different order. One or more of the blocks of the method may be performed contemporaneously. Blocks may be added or omitted.

Figures 6A, 6B, 6C, 6D, 6E:
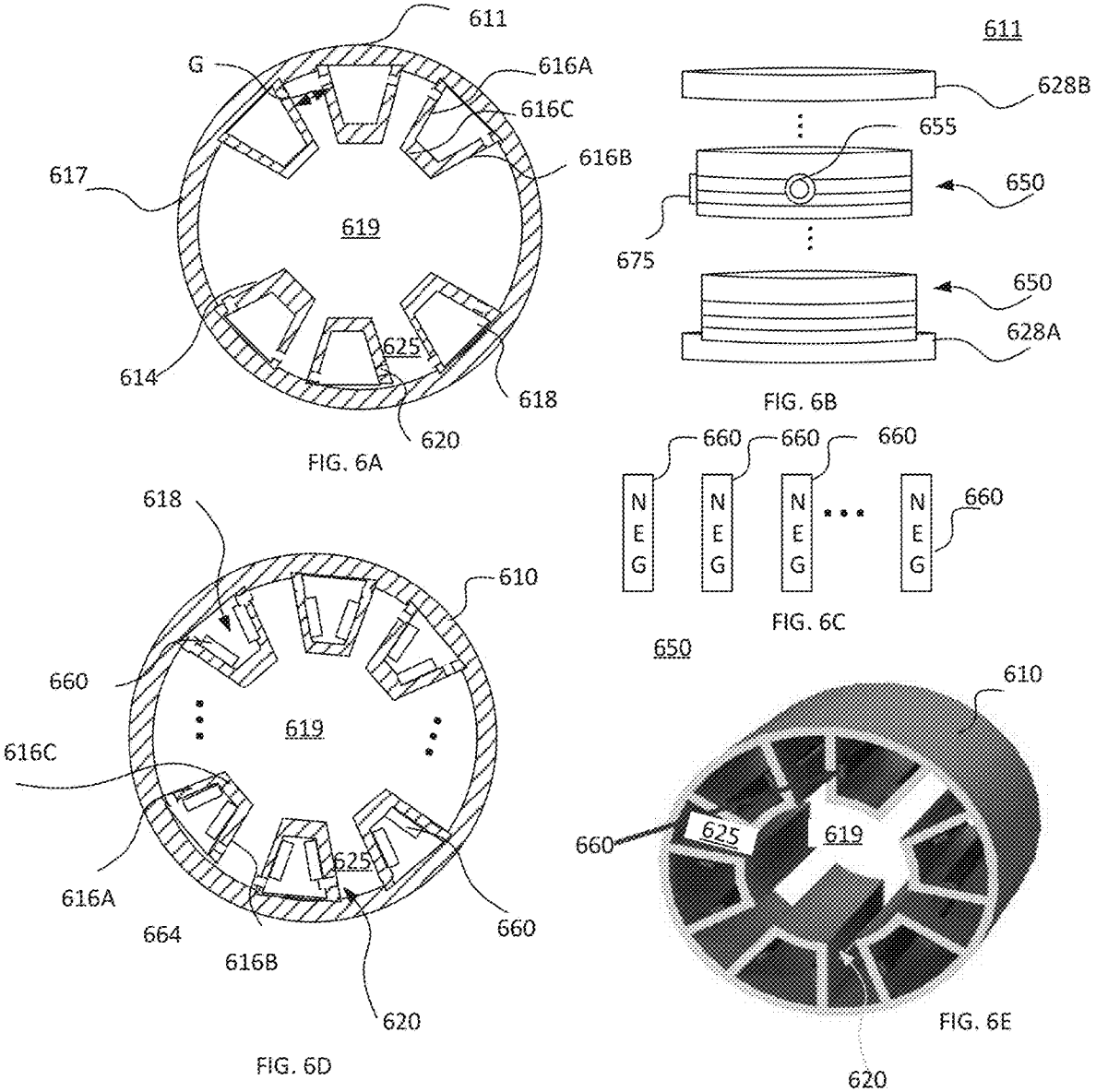
FIG. 6A illustrates a top view of a layer of VT RF cavity enclosure manufactured using a three-dimensional (3D) additive manufacturing protocol.
FIG. 6B illustrates a side view of multiple layers of the VT RF cavity enclosure.
FIG. 6C illustrates a plurality of NEG modules.
FIG. 6D illustrates a top view of a section of the VT RF cavity enclosure with integrated NEG modules in the RF cavity.
FIG. 6E illustrates a perspective view of the section of the VT RF cavity enclosure with the integrated NEG modules.

The method 500 may include, at block 502, depositing RF cavity enclosure material to form an electrode of a first polarity into a layer formation including a tubular section 617 (FIG. 6A) with periodic or nearly periodic interior structures 614 (FIG. 6A) radially or axially arranged periodically around a hollow center 619 (FIG. 6A) of the tubular section 617. As best seen in FIG. 6A, the gaps G between adjacent interior structures 614 and the surface contour of oppositely facing side walls of interior structure 614 defines a geometric-shaped resonating cavity 625 for a particular resonating frequency response. FIG. 6A illustrates a top view of a layer 601 of vacuum tube RF cavity enclosure manufactured using a three-dimensional (3D) additive manufacturing protocol or 3D printing. The hollow center 619 being configured to receive the diameter of the opposite polarity electrode 105 (FIG. 1B). In hollow center 619, the opposite polarity electrode 105 (FIG. 1B) may be journaled therein. By way of non-limiting example, each interior structure 614 has a trapezoidal shape. For example, walls 616A and 616B are generally sloped with the widest distance between the walls 616A and 616B being in proximity to the surface of the tubular section 617. The narrowest distance between walls 616A and 616B being in proximity to hollow center 619. Accordingly, the resonating cavity 625 is formed by a gap between adjacent interior structures 614. Thus, the widest gap of the cavity 625 is closest to the hollow center 619 and the narrowest gap of the cavity 625 is closest to the surface of the tubular section 617.

The geometric shape may be determined using conventional modeling and simulation known in the art, such as computer modeling and analytical modeling. However, the interior structures may be subsequently refined in shape to achieve the actual resonate frequency. By way of non-limiting example, the interior structure may be increased or decreased in height, width, length or other feature size so that the resonating cavity produces the actual frequency in use. The resonating cavity may be circular, square, rectangular, or trapezoidal. The side walls of the interior structure would be concaved.

The method 500 may include, at block 504, growing the tubular section 617 with the periodic or nearly periodic interior structures 614 (radially or axially arranged) with hollow cavities 618. The method 500 may include, at block 506, during growing the tubular section 617 creating vents 620 in at least one side wall of the interior structures 614 with voids.

FIG. 6B illustrates a side view of multiple stacked layers 601 of the VT RF cavity enclosure 611. The multiple layers 601 produce one or more RF enclosure sections 650 of RF cavity enclosure as seen in FIG. 6E or FIG. 7B. The method 500 may include, at block 508, retrieving one or more NEG modules 660. FIG. 6C illustrates a plurality of NEG modules 660. The method 500 may include, at block 510, installing the NEG modules 660 onto one or more side walls within one or more internal hollow sub-cavities 618 or 718. The NEG modules 660 are installed in the internal hollow sub-cavities 618 or 718 of the structures 614 on one of side walls 616A and 616B or 716. In some embodiments, the NEG modules 660 may be installed to an underside of side wall 616C or on the tubular section 617 or 717 within the internal hollow cavities 618 or 718. The resonating RF cavity 625 of the RF cavity enclosure is free of protrusions within the resonating RF cavity 625 or 725. Likewise, the passthrough created between the circumferentially/longitudinally spaced structures 614 is free of protrusions that would obstruct the placement of the opposite polarity electrode 105 (FIG. 1B).

FIG. 6D illustrates a top view of a section 650 of the VT RF cavity enclosure 611 with integrated NEG modules 660. During manufacturing, a plurality of sections of the vacuum tube RF cavity enclosure may be formed or grown the interior of which form a resonating RF cavity. For example, a section of the RF cavity enclosure may be formed, and a first set of NEG modules installed. A next section 350 of the RF cavity enclosure 611 in-line with the first section 350 may be grown. Then, a second set of NEG modules 660 may be installed in said next section before growing in-line another RF cavity section 350. The process is repeated until a length of vacuum tube RF cavity is achieved. Nonetheless, the full length of the RF cavity enclosure may be grown before installing any of the NEG modules.

FIG. 6E illustrates a perspective view of an RF cavity enclosure section 650 of a main vacuum tube (VT) chamber 610 with grown layers of the VT RF cavity enclosure 611 and installed integrated NEG modules 660.

The method 500 may comprise, at block 520, creating a first flange 628A at a first end of the RF cavity enclosure 611 when growing the RF cavity enclosure, as best seen in FIG. 6B. The method 500 may comprise, at block 522, creating access port 675 for the second sub-assembly 170 (FIGS. 1A and 1B) while growing the RF cavity enclosure 611. The method 500 may comprise, at block 524, creating at least one access port 655 for the third sub-assembly 150 (FIGS. 1A and 1B) while growing the RF cavity enclosure 611. The RF cavity enclosure may require multiple access ports 655 or no access ports. Access ports are grown at locations designed for the RF cavity enclosure 611. Blocks 522 and 524 may be optional.

The method 500 may comprise, at block 526, creating a second flange 628B at a second end of the RF cavity enclosure 611 when growing the RF cavity enclosure, as best seen in FIG. 6B. The method 500 may comprise, at block 528, journaling an opposite polarity electrode though the RF cavity enclosure 611 and sealing the RF cavity enclosure at block 530 wherein an interior of the RF cavity enclosure 611 comprises a resonating RF cavity.

In some embodiments, the method 500 may include while growing the RF cavity enclosure layers, surrounding the RF cavity enclosure with an outer layer of metal or conductive material.

FIG. 7A illustrates a perspective view of another RF cavity enclosure 711 with axially arranged periodic interior structures with integrated NEG modules. FIG. 7B illustrates a cross-sectional view of the RF cavity enclosure 711 of FIG. 7A. The RF cavity enclosure 711 of FIGS. 7A and 7B is formed using similar principles as the RF cavity enclosure of FIGS. 6A-6E based on the method 500 of FIGS. 5A-5B. The RF cavity enclosure 711 is generally a hollow tubular structure with axially arranged ring-shaped interior structure 716 having an interior hollow cavity 719 for the placement of NEG modules 760. The geometric shape of the NEG modules 760 may be a function of each interior structure 714. The NEG module 760 may be configured to be attached to the tubular section 717 wherein the tubular section may serve as a floor of the internal hollow cavity 719. The ring-shaped interior structures 716 circumnavigate the interior circumferential surface of the RF cavity enclosure 711 within the resonating RF cavity.

The ring-shaped interior structure 716 has side walls, at least one of which includes vents 720. The longitudinal center 719 of the RF cavity enclosure 711 is hollow for the receipt of opposite polarity electrode 105 (FIG. 1B).

The method of manufacturing the embodiment of FIGS. 7A and 7B is generally the same as FIGS. 1A and 1B except that instead of growing radially arranged periodic interior structures, the interior structures are grown periodically arranged in the direction of the longitudinal center as ring-shaped interior structures.

Figure 8:
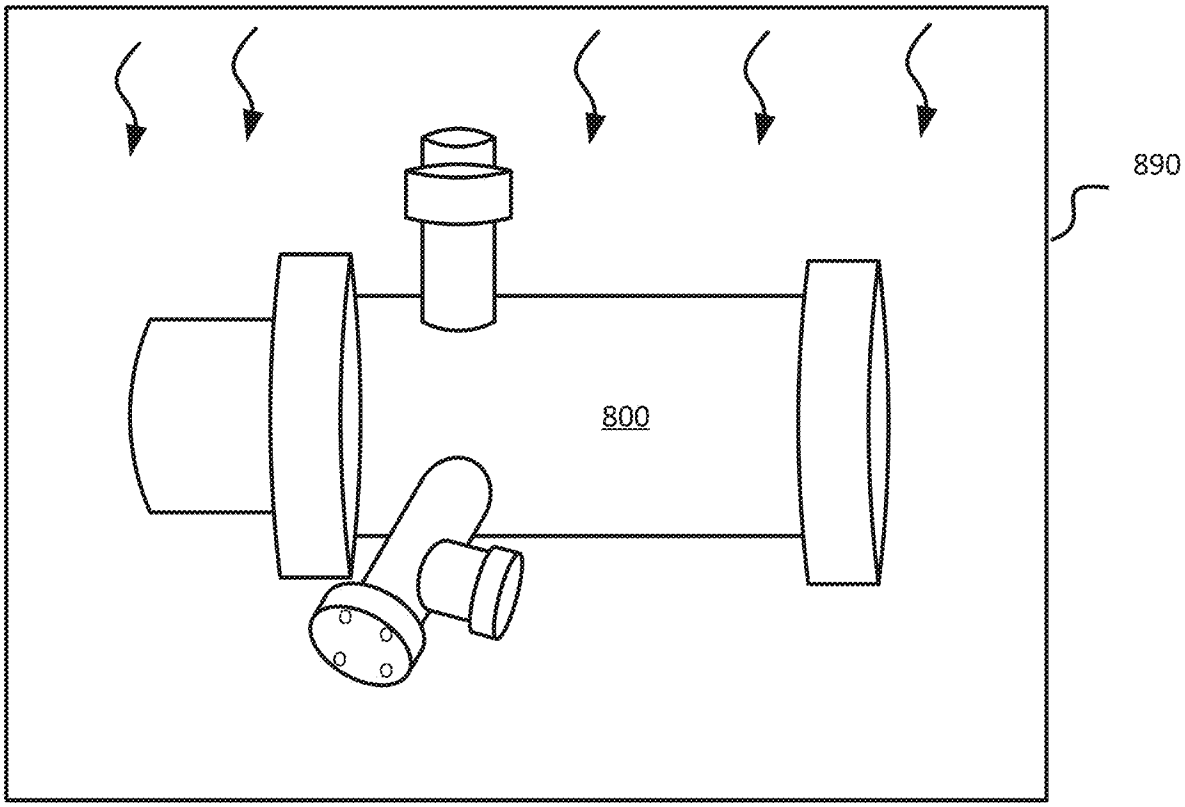
FIG. 8 illustrates the HPM-VT device of FIG. 1 in a heating source.

FIG. 8 illustrates the HPM-VT device 800 (i.e., HPM-VT device 100 of FIGS. 1A and 1B) in a heating source 890. The heating source 890 may be configured to house all or part of the HPM-VT device 800. The heat radiated from the heating source 890 being configured to heat the non-evaporable getters (NEG) modules (i.e., NEG module 160 of FIGS. 1A and 1B) made of NEG material to initialize or re-initialize the NEG material to begin sorbing (absorbing) of active gas within the HPM-VT device 800 or to continue sorbing of the active gas within the HPM-VT device 800.

As can be appreciated, in some embodiments, an electrical energy source may be provided to the NEG module to initialize or re-initialize the NEG material via joule heating. In this instance, the NEG module would be coupled to the electrical energy source via the RF cavity enclosure or decoupled from the RF cavity enclosure with electrical energy provided via conductive wires through sub-assemblies 170 and/or 150.

Figure 9A:
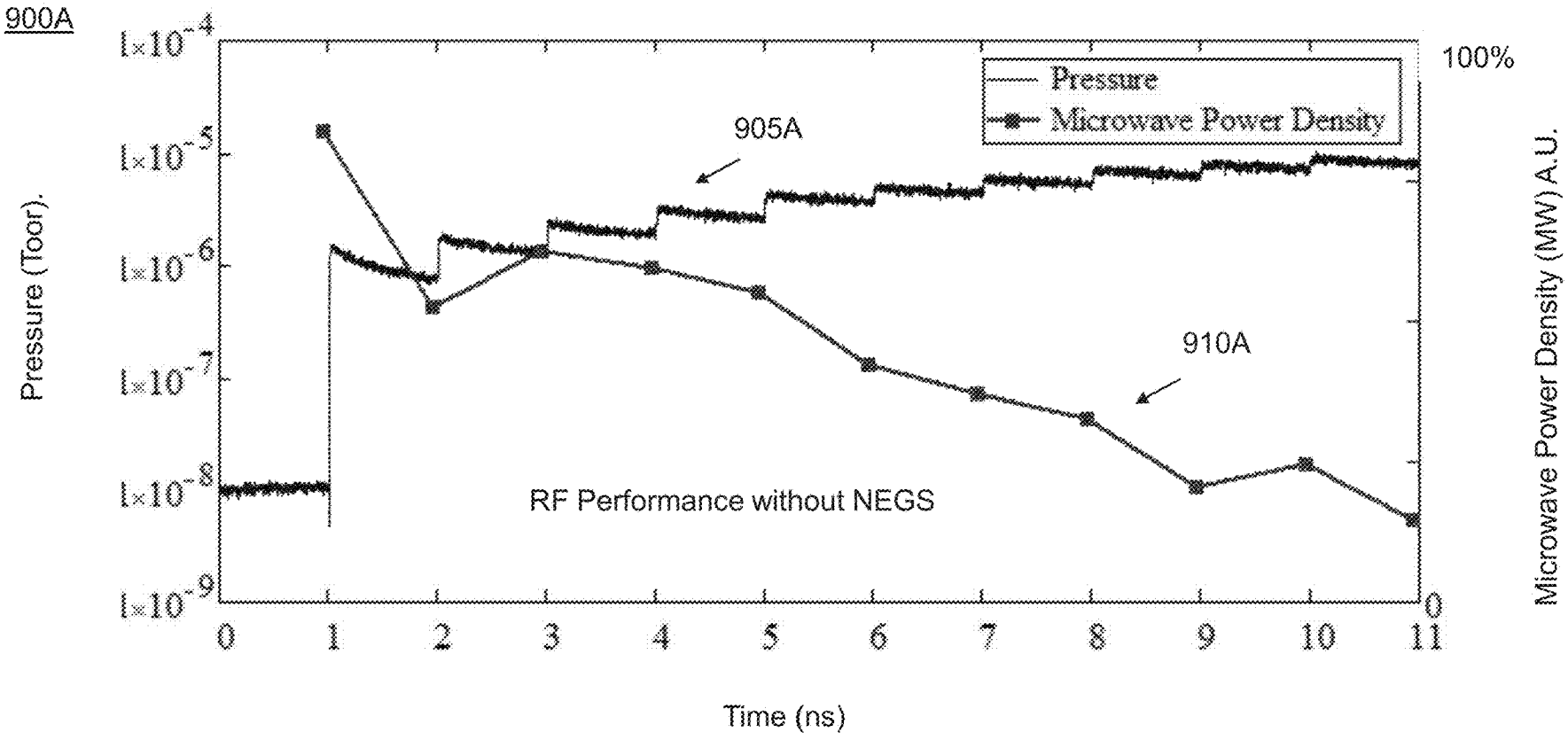
FIG. 9A illustrates a graphical representation of the radio frequency (RF) performance of a conventional high-power microwave vacuum tube device without NEG modules.

FIG. 9A illustrates a graphical representation 900A of the radio frequency (RF) performance of a conventional high-power microwave vacuum tube device without NEG modules. Line 905A is a graphical representation of pressure in Torr verses RF pulse number related to the operation of a conventional HPM-VT device with NEG material or NEG modules. Line 910A is a graphical representation of radiated microwave power in arbitrary units for the same RF pulse number. In this graph, as the pressure increases, as illustrated by line 905A, the radiated microwave power in arbitrary units (A.U.) decreases, as illustrated by line 910A. Line 910A is shown decreasing.

Figure 9B:
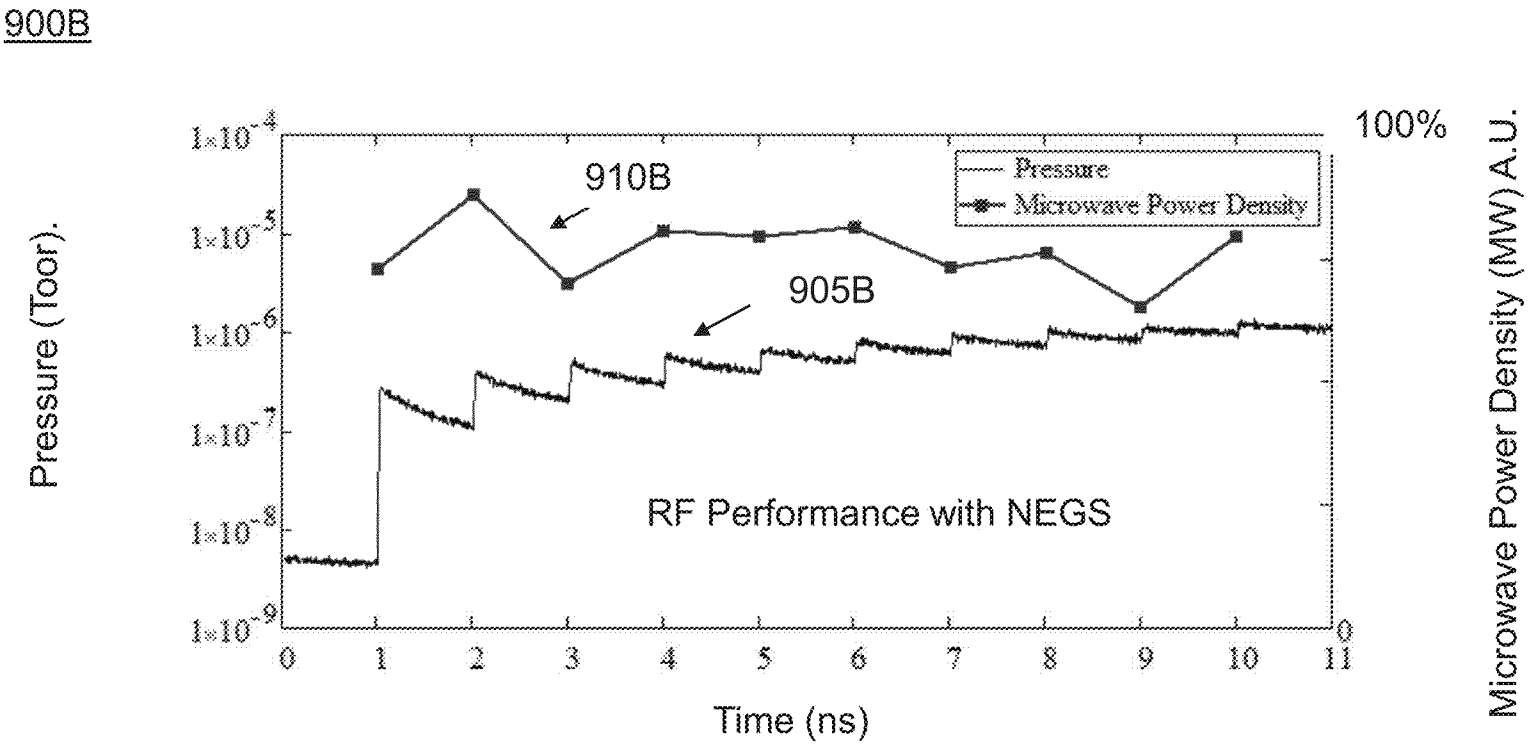
FIG. 9B illustrates a graphical representation of the radio frequency (RF) performance of the HPM-VT device with integrated NEG modules.

FIG. 9B illustrates a graphical representation 900B of the radio frequency (RF) performance of the high-power microwave vacuum tube device with integrated NEG modules. Line 905B is a graphical representation of pressure in Torr verses RF pulse number related to the operation of the HPM-VT device 100 with NEG material or NEG modules of FIG. 1. Line 910B is a graphical representation of the radiated microwave power (A.U.) for the same RF pulse number. In this graph, as the pressure increases, as illustrated by line 905B, the radiated microwave power (A.U.) slightly decreases, as illustrated by line 910B. Line 910B is shown fluctuating.

Traditional high-power microwave vacuum tube devices require the use of large vacuum support equipment during operational use or require a high degree of maintenance for long shelf life. Integrating a non-evaporable getter material into the high-power microwave device improves operation such as, without limitation, in single pulse operation, burst mode operation, as well as improves shelf life with little to no maintenance.

Figure 10:
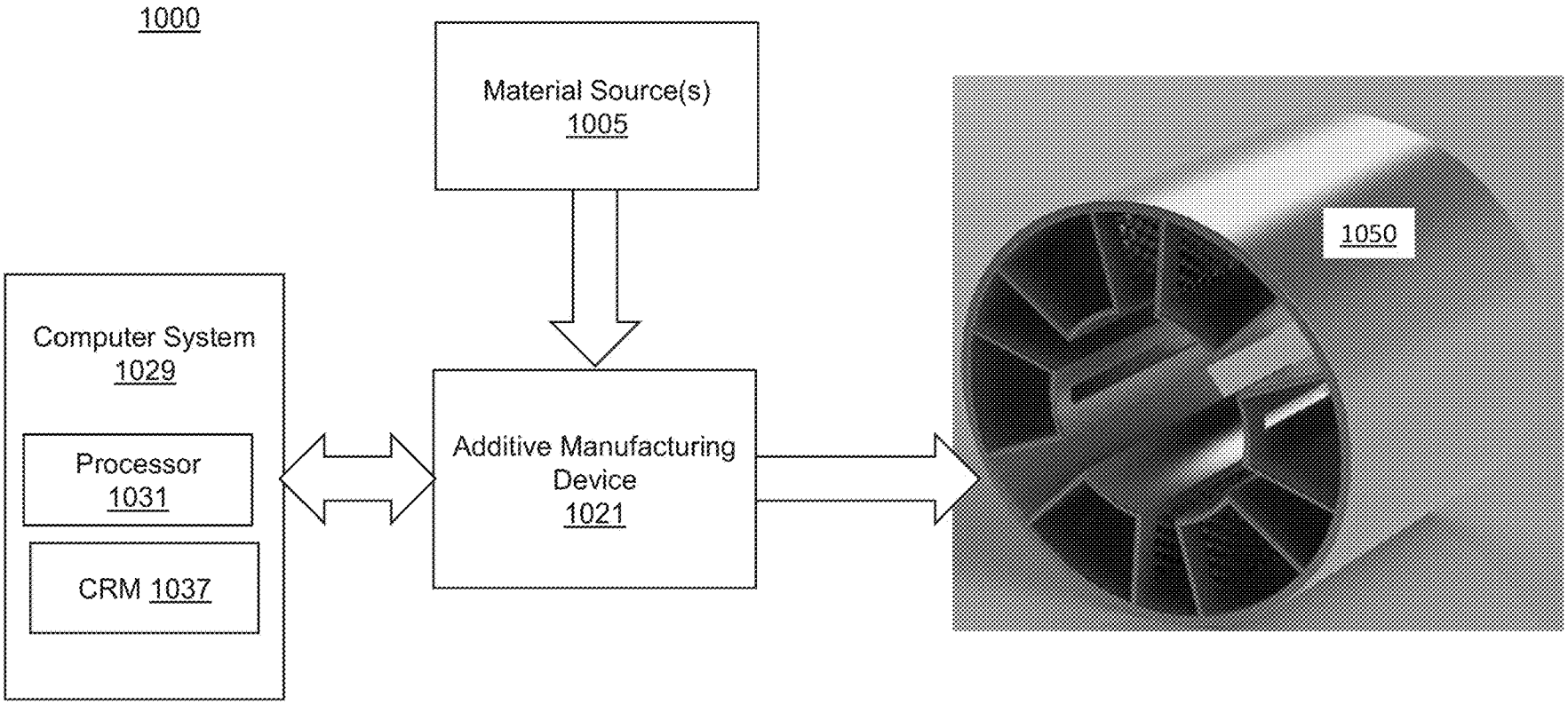
FIG. 10 illustrates an additive manufacturing system for forming layers of a radio frequency enclosure section.

FIG. 10 illustrates an additive manufacturing system 1000 for forming layers of a radio frequency enclosure section 1050, as described above in relation to FIGS. 6A-6E using the method 500 described in relation to FIGS. 5A-5B. One or more of the blocks of method 500 may be performed using the additive manufacturing system 1000.

The additive manufacturing system 1000 may include an additive manufacturing device (AMD) 1021 such as, without limitation, a three-dimensional (3D) printer or other additive manufacturing platform known in the art. The additive manufacturing system 1000 may include at least one material source 1005 configured to be fed to the AMD 1021 to form section 1050 layer by layer. The AMD 1021 may be controlled by a computer system 1029. The computer system 1029 may include at least one processor 1031. The computer system 1029 may be integrated into the AMD 1021, in some embodiments. The method 500 may be implemented as software programming code stored on non-transitory and tangible computer readable medium (CRM) 1037. The computer system 1029 may communicate wired or wirelessly with the AMD 1021. The computer system 1029 may be a personal computer (PC) system, a mobile computing system platform, or other computing platforms.

The programming code may be configured to manufacture the RF cavity enclosure (i.e., RF cavity enclosure 611) or parts thereof. By way of non-limiting example, the programming code may be configured to define the dimensions of a wall thickness and/or inner and outer diameters of the tubular section (i.e., tubular section 617). The programming code may be configured to define the wall thickness, height and length of the side walls (i.e., walls 616A and 616B) and the thickness and length of wall 616C, for example. The programming code may be configured to determine the vent pattern, size, shape and location. The programming code may be configured to determine the location and diameters of the access ports. The programming code may be configured to determine the height and shape of each interior structure (i.e., structure 614) and periodicity. The programming code may be configured to determine a size (radius or diameter) of the hollow center 619, for example. The programming code may be configured to determine the number of layers needed to build a section (i.e., section 650) and inner and outer diameters of the flanges (i.e., flanges 628A and 628B).

The programming code may include a graphical user interface which allows the user to enter selections of any of the dimensions entered above to initialize setting to print the RF cavity enclosure, for example. In some embodiments, the settings to manufacture the RF cavity enclosure may be pre-programmed. The programming code may be configured to provide the user selections for a particular interior structure shape for a particular resonating frequency response by a resonating cavity (i.e., resonating cavity 625).

The terminology used herein is for the purpose of describing particular embodiments only and is not intended to be limiting. As used herein, the singular forms "a," "an," and "the" are intended to include the plural forms as well, unless the context clearly indicates otherwise. Furthermore, to the extent that the terms "including," "includes," "having," "has," "with," or variants thereof are used in either the detailed description and/or the claims, such terms are intended to be inclusive in a manner similar to the term "comprising." Moreover, unless specifically stated, any use of the terms first, second, etc., does not denote any order or importance, but rather the terms first, second, etc., are used to distinguish one element from another.

Unless otherwise defined, all terms (including technical and scientific terms) used herein have the same meaning as commonly understood by one of ordinary skill in the art to which embodiments of the invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

While various disclosed embodiments have been described above, it should be understood that they have been presented by way of example only, and not limitation. Numerous changes, omissions and/or additions to the subject matter disclosed herein can be made in accordance with the embodiments disclosed herein without departing from the spirit or scope of the embodiments. Also, equivalents may be substituted for elements thereof without departing from the spirit and scope of the embodiments. In addition, while a particular feature may have been disclosed with respect to only one of several implementations, such feature may be combined with one or more other features of the other implementations as may be desired and advantageous for any given or particular application. Furthermore, many modifications may be made to adapt a particular situation or material to the teachings of the embodiments without departing from the scope thereof.

Further, the purpose of the foregoing Abstract is to enable the U.S. Patent and Trademark Office and the public generally and especially the scientists, engineers and practitioners in the relevant art(s) who are not familiar with patent or legal terms or phraseology, to determine quickly from a cursory inspection the nature and essence of this technical disclosure. The Abstract is not intended to be limiting as to the scope of the present disclosure in any way.

Therefore, the breadth and scope of the subject matter provided herein should not be limited by any of the above explicitly described embodiments. Rather, the scope of the embodiments should be defined in accordance with the following claims and their equivalents.

We claim:

1. A device, comprising:

an RF cavity enclosure including a conductive tubular section having a plurality of interior structures radially or axially arranged which forms an unobstructed inner hollow center within the tubular section, each interior structure of the plurality of interior structures includes side walls between which is formed an internal hollow sub-cavity;

resonating cavities within the RF cavity enclosure between adjacent interior structures to produce a resonating frequency response; and vents formed in at least one side wall of said each interior structure for permeation of a gas into the internal hollow sub-cavity.

2. The device of claim 1, wherein the plurality of interior structures is periodically arranged within an interior of the tubular section and the resonating cavities are periodic.

3. The device of claim 1, further comprising an outer layer of material surrounding the tubular section of the RF cavity enclosure.

4. The device of claim 1, wherein the RF cavity enclosure is made of conductive material.

5. The device of claim 1, wherein the RF cavity enclosure further comprising:

a first flange at a first end of the tubular structure; and a second flange at a second end of the tubular structure.

6. The device of claim 1, wherein the RF cavity enclosure further comprising: one or more access ports having a center which is perpendicular to the center of the RF cavity enclosure.

7. The device of claim 1, further comprising at least one non-evaporable getter (NEG) module in the at least one internal hollow sub-cavity.

8. A method, comprising:

forming a layer of an RF cavity enclosure including a conductive tubular section having a plurality of interior structures radially or axially arranged which forms an unobstructed inner hollow center within the tubular section, each interior structure of the plurality of interior structures includes side walls between which forms an internal hollow sub-cavity;

during the forming of the layer of the RF cavity enclosure, forming, in at least one side wall of said each interior structure, at least one vent for permeation of a gas into the internal hollow sub-cavity; and repeating the forming of the layer of the RF cavity enclosure using additive manufacturing to produce a length of the RF cavity enclosure having a plurality of layers and the forming of the at least one vent in the at least one side wall.

9. The method of claim 8, wherein during the forming of the layer of the RF cavity enclosure, the method further includes forming the plurality of interior structures periodically which forms periodic resonating cavities between adjacent interior structures.

10. The method of claim 8, further comprising forming an outer layer of material surrounding the tubular section of the RF cavity enclosure for each layer of the RF cavity enclosure.

11. The method of claim 8, wherein the RF cavity enclosure is made of conductive material.

12. The method of claim 8, wherein when forming the plurality of layers of the RF cavity enclosure the method further comprising:

forming a first flange at a first end of the tubular structure; and forming a second flange at a second end of the tubular structure.

13. The method of claim 8, wherein when forming the plurality of layers of the RF cavity enclosure further comprising: forming one or more access ports having a center which is perpendicular or angled relative to the center of the RF cavity enclosure.

14. The method of claim 8, further comprising:

installing at least one non-evaporable getter (NEG) module in the internal hollow sub-cavity of said each interior structure.

15. A system, comprising:

an RF cavity enclosure being an electrode and including a tubular section having a plurality of interior structures radially or axially arranged which forms an unobstructed inner hollow center within the tubular section, each interior structure of the plurality of interior structures includes side walls between which is formed an internal hollow sub-cavity;

resonating cavities between adjacent interior structures configured to produce a resonating frequency response;

non-evaporable getter (NEG) modules installed in the internal hollow sub-cavity of said each interior structure;

vents formed in at least one side wall of said each interior structure for permeation of a gas into the internal hollow sub-cavity; and an opposite polarity electrode journaled along the inner hollow center.

16. The system of claim 15, wherein the plurality of interior structures is periodically arranged within an interior of the tubular section wherein the resonating cavities are periodic.

17. The system of claim 15, further comprising an outer layer of material surrounding the tubular section of the RF cavity enclosure.

18. The system of claim 15, wherein the RF cavity enclosure is made of conductive material.

19. The system of claim 15, further comprising a high-power microwave device integrating the RF cavity enclosure with the NEG modules which eliminates at least one external vacuum pump.

20. The system of claim 15, wherein the RF cavity enclosure further comprising:

a first flange at a first end of the tubular structure; and a second flange at a second end of the tubular structure.

* * * * *